US006360664B1

(12) United States Patent
Göttling et al.

(10) Patent No.: US 6,360,664 B1
(45) Date of Patent: Mar. 26, 2002

(54) APPARATUS FOR THE AXIAL GUIDANCE AND ADJUSTMENT OF A CYLINDER

(75) Inventors: Josef Göttling, Friedberg; Robert Kersch, Dasing; Gerd Kunert, Augsburg; Horst Dauer, Rohrbach, all of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/496,309

(22) Filed: Feb. 1, 2000

(30) Foreign Application Priority Data

Feb. 1, 1999 (DE) ..... 199 03 847

(51) Int. Cl.[7] ..... B41F 13/14
(52) U.S. Cl. ..... 101/481; 101/486
(58) Field of Search ..... 101/480, 485, 101/486, 481, 248, DIG. 38, 286

(56) References Cited

U.S. PATENT DOCUMENTS 3,746,957 A * 7/1973 Forster et al. ..... 101/248
4,606,269 A * 8/1986 Jeschke et al. ..... 101/248
4,785,733 A * 11/1988 Hartung et al. ..... 101/248
5,389,846 A * 2/1995 Okazaki et al. ..... 310/40

FOREIGN PATENT DOCUMENTS

| | | | | |
|---|---|---|---|---|
| DE | 971 107 | | 12/1958 | |
| DE | 3409 194 A1 | | 9/1985 | ..... B41F/13/14 |
| JP | 62-32051 A | * | 2/1987 | ..... 101/348 |
| JP | 63-13747 | * | 1/1988 | |
| JP | 1-210345 | * | 8/1989 | |

* cited by examiner

*Primary Examiner*—Daniel J. Colilla
(74) *Attorney, Agent, or Firm*—Cohen, Pontani, Lieberman & Pavane

(57) ABSTRACT

An apparatus constructed which accurately guides and adjusts a cylinder axially in a rotary printing machine. For this purpose, an electromagnetic system, with which an axial force can be applied to the cylinder, is arranged on the frame of the rotary printing machine. The cylinder is mounted in mountings that permit axial displacement.

26 Claims, 5 Drawing Sheets

APPARATUS FOR THE AXIAL GUIDANCE AND ADJUSTMENT OF A CYLINDER

BACKGROUND OF THE INVENTION

1. Field of the Invention

The invention relates to printing machines, and more particularly to an apparatus for the axial guidance and adjustment of a plate cylinder in a rotary printing machine.

2. Description of the Related Art

In a color print, the color images to be printed one after another have to be printed in register with one another. For this purpose, in rotary printing machines the plate cylinder can be adjusted with respect to the lateral, circumferential and, if necessary, diagonal register, apart from solutions in which the printing plate is adjusted directly. For the purpose of adjusting the lateral register, the plate cylinder is shifted in the axial direction. In this context, DE 34 09 194 A 1 describes an apparatus in which the axial movement is produced by means of a threaded spindle driven by a motor. The threaded spindle is connected to the journal of the plate cylinder via ball bearings.

This apparatus is complicated in design and is thus expensive with regard to the manufacturing costs. Furthermore, mechanical parts are affected by play and are subject to wear which increases the play. The play impairs the axial fixing of the cylinder and hence the constancy of register. In addition, during the adjustment of the cylinder position, hysteresis deviations which influence the register occur.

SUMMARY OF THE INVENTION

It is therefor an object of the invention to provide an apparatus which is constructed from simple means and which accurately guides and adjusts the cylinder axially.

According to the invention, the apparatus can be set up cost-effectively and such that it renders mechanical gear mechanisms for lateral register adjustment superfluous. It permits the cylinder to be guided without contact and, as a result, without wear and hysteresis, by means of mechanical drives. In an advantageous embodiment of the invention, through direct measurement of the actual position of the cylinder, the associated influence of hysteresis is also dispensed with. As a result, the cylinder is axially positioned and adjusted very accurately overall, which means that a high register accuracy and thus good print quality can be achieved.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The invention is to be explained in more detail below using some exemplary embodiments. In the associated drawings.

DETAILED DESCRIPTION OF THE PRESENTLY PREFERRED EMBODIMENTS

Figure 1:
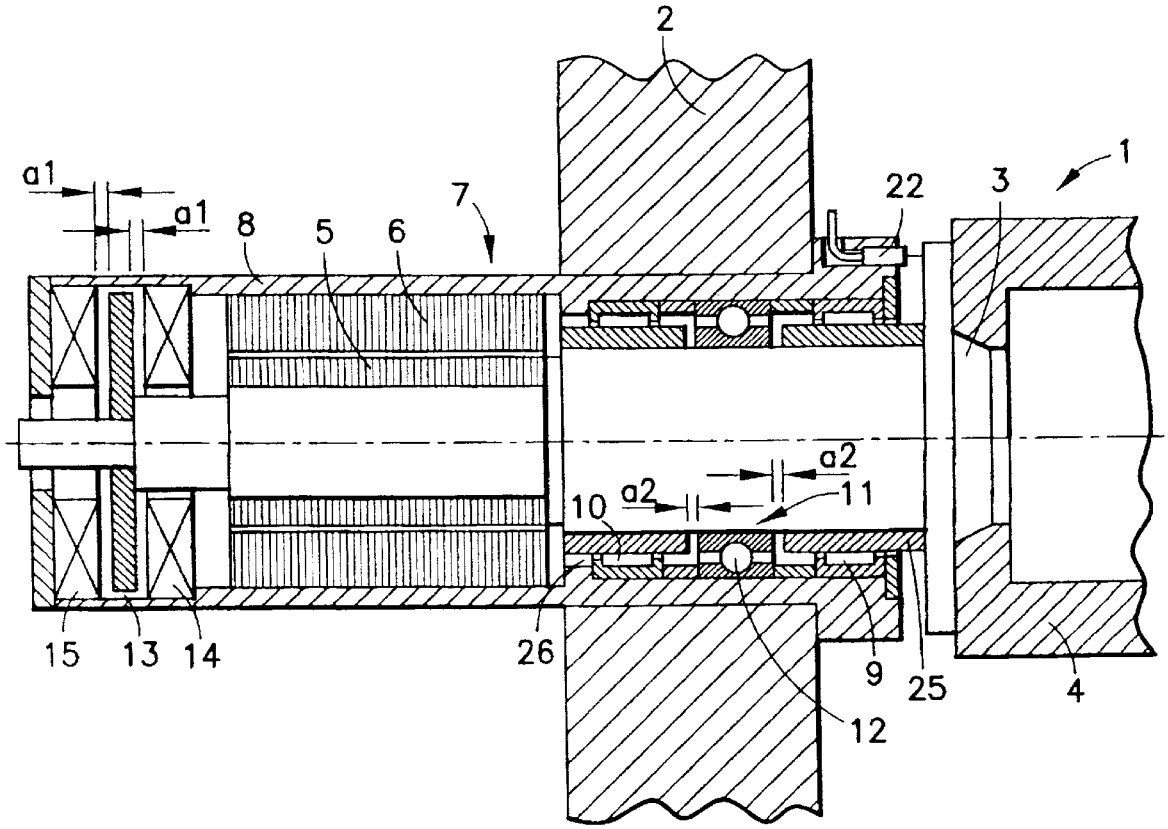
FIG. 1 is a cross-sectional view of an apparatus for the axial guidance and adjustment of a cylinder with two magnetic coils.

FIG. 1 shows a cylinder 1 of a rotary printing machine, which is cantilever-mounted in a side wall 2 (frame). The cylinder 1 is a plate cylinder, however, it could also be another cylinder, for example a transfer cylinder. The cylinder is set up in a spindle design, that is to say the body 4 of the cylinder 1 is flange-mounted on the head of a spindle 3. Other designs and mountings of cylinders are also possible, as will be shown in following exemplary embodiments. The spindle 3, together with the rotor 5 arranged on it and with the stator 6 of a built-in motor 7, is accommodated in a housing 8, which in turn is accommodated in the wall 2. The spindle 3 is mounted in the housing 8 with radial bearings 9, 10 with the ability to be displaced axially, for example cylinder roller bearings. Furthermore, a stop system 11 which does not impair the ability of the cylinder 1 to rotate is arranged in the housing 8 and contains a grooved ball bearing 12 which is accommodated in the bore in the housing 8 and which interacts with two sleeves 25, 26 on the spindle 3.

Also arranged on the cylinder 1 is an electromagnetic system. In detail, a disc 13 made of a ferromagnetic material is fastened on the spindle 3, in each case a magnetic coil 14, 15 accommodated in the bore of the housing 8 being arranged on both sides of the disc, at a distance from the sides. The disc 13 incorporates two mutually oppositely oriented ferromagnetic surfaces. In order to achieve a high operating accuracy of the apparatus, the surfaces of the disc 13 have the lowest possible axial run-out, and the disc 13 is extremely homogeneous, for example does not contain any voids.

Figure 4:
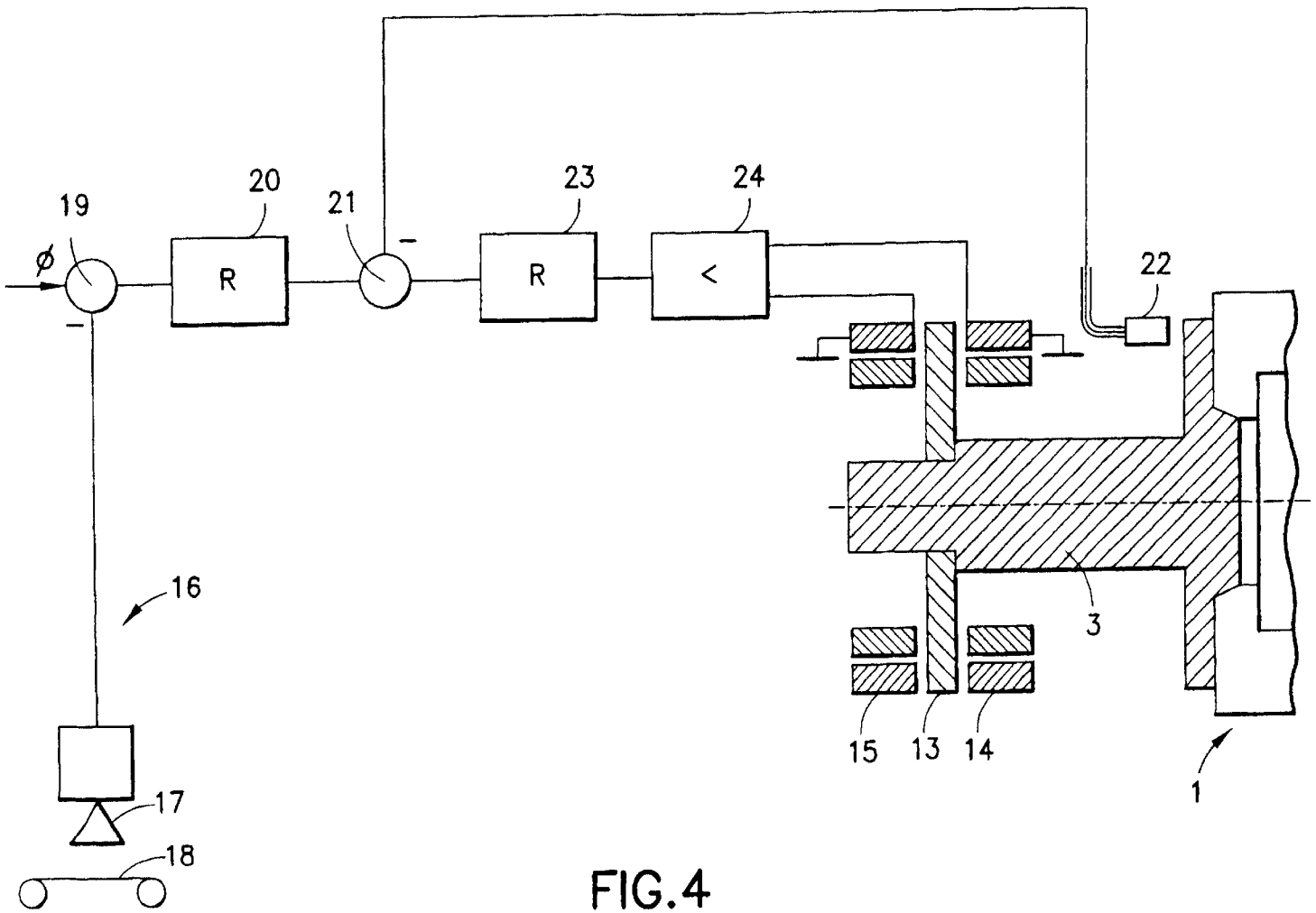
FIG. 4 is a schematic block diagram relating to driving the magnetic system.

The magnetic coils 14, 15 of the electromagnetic system are driven by a register control system, as shown in FIG. 4. In detail, a sensor 17, which scans register marks printed on a web 18, is connected to the input of a comparison device 19, to which a signal for the desired value of the register is also fed. On the output side, the comparison device 19 is connected via a control device 20 to a further comparison element 21. A measured value transmitter 22 for the position of the cylinder 1 is connected to the second input of the comparison element 21. On the output side, the comparison device 21 is connected via a control device 23 and an amplifier 24 to the magnetic coils 14, 15 of the electromagnetic system.

The signal supplied by the sensor 17 for the actual value of the register is compared with a desired value in the comparison element 19. The difference signal obtained in this way, conditioned by the control device 20, is fed to the comparison element 21 and there is compared with the signal supplied by the measured value transmitter 22 for the actual position of the cylinder 1. In the event of a deviation from the desired value, a difference signal is forwarded to the control device 23. There, the signal for driving the magnetic coils 14, 15 is prepared and fed to the coils after appropriate amplification in the amplifier 24. In the driven state, that is to say when they are energized, the magnetic coils 14, 15 exert pulling forces on the disc 13. The disc 13 is shifted in the direction of the magnetic coil which exerts the greater attractive force on it.

The adjustment operation preferably takes place when the spindle 3 is rotating. As a result, the adjustment does not take place with any sliding displacement in the direction of the circumferential contact lines of the rolling elements, but in a less harmful manner by rolling helically on the rolling elements. When it is established that the desired position of the cylinder 1 has been reached based on the signal output by the measured value transmitter the magnetic coils 14, 15 are energized such that the position is maintained.

The apparatus uses the position of the cylinder 1, determined by measurement, for the active control of the energization of the two magnets. As a result, stable, freely selectable, accurate axial positioning of the cylinder 1 can be achieved. The measured value transmitter 22 used is advantageously a non-contacting, inductive, capacitive, optical, interferometric or mechanical sensor. The reference surface needed for the measured value transmitter 22, which surface can be designed as a disc, for example, is advantageously fitted close to the body 4 of the cylinder, for example on the head of the spindle 3 which bears the body 4 or at the end of the body 4 of the cylinder. As a result, disruptive influences, such as problems with electromagnetic compatibility thermal influences, for example thermal expansion of the spindle 3, and contamination are minimized.

The distances a2 between the sleeves 25, 26, and the grooved ball bearing 12 (FIG. 1), as well as the distances a1 between the magnetic coils 14, 15 and the disc 13, are such that, assuming central positions of the grooved ball bearing 12 and of the disc 13, a2 is less than a1. In the end positions, the sleeves 25, 26 strike the grooved ball bearing 12 and thus limit the axial displacement travel of the cylinder 1. In addition, this stop system 11 means that damage is avoided in the event of any disruption to the electromagnetic system 14, 15. In the case of any possible disruption of this type, the cylinder 1 can run down to a standstill without any risk and without any further axial guidance. Sleeves 25, 26 may strike the grooved ball bearing 12, by which means any mechanical collision between the disc 13 and the magnetic coils 14, 15, and any associated damage, is avoided.

The stop system 11 having the grooved ball bearing 12 and the sleeves 25, 26 can also be employed for very accurate axial positioning of the cylinder 1, such as is required for example for the direct imaging of a plate cylinder in the printing machine. For this purpose, the magnetic coils 14, 15 are driven such that the sleeves 25, 26 of the cylinder 1 are in contact with the grooved ball bearing 12. The ground bearing 12 performs the function of a supporting bearing and guarantees the highest accuracy with regard to the axial running of the cylinder 1 as it rotates. This axial stop can also be implemented in another way, for example by means of angled ball bearings or tapered roller bearings arranged in pairs.

Figure 2:
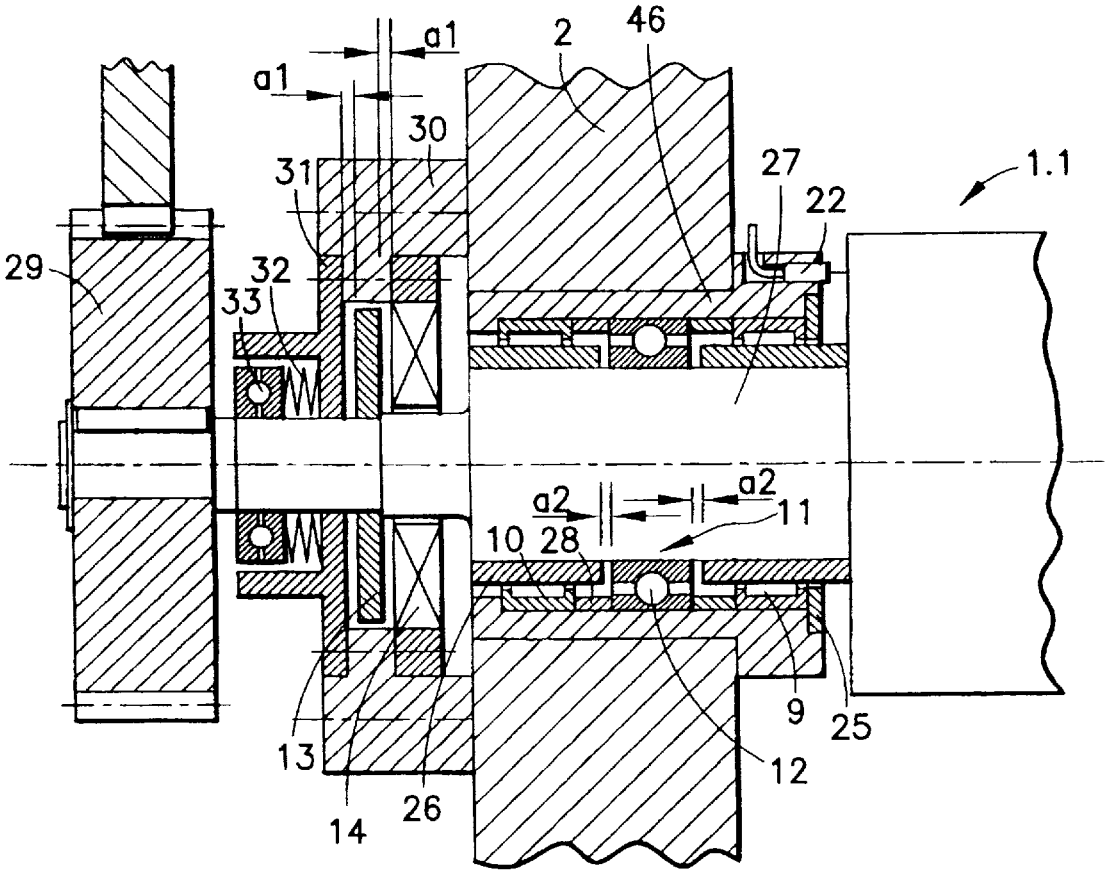
FIG. 2 is a cross-sectional view of an embodiment in which one magnetic coil is replaced by a spring.

FIG. 2 shows a further embodiment, in which one magnetic coil is replaced by a spring. For the purpose of simplification, in this exemplary embodiment and in the one following, in the case of repeated and similar components the same item numbers are used, if necessary with the addition of "0.1", "0.2". A cylinder 1.1, by way of example not designed with a spindle and flange-mounted body, is cantilever-mounted with its journal 27 in the side wall 2. The mounting is carried out in a bush 28 accommodated in the side wall 2, otherwise in the latter by means of radial bearings 9, 10, analogously to FIG. 1. Also provided is the grooved ball bearing 12, which interacts with the sleeves 25, 26. In order to drive the cylinder 1.1, a spur gear 29 is arranged on its journal 27. The drive could also be carried out by means of a dedicated motor, for example in a manner similar to the design according to FIG. 1. Fastened on the journal 27 of the cylinder 1.1 is a disc 13 of a ferromagnetic material, on one of whose sides, which supplies a ferromagnetic surface, and at a distance from the said side there is arranged a magnetic coil 14. The magnetic coil 14 is fastened in a housing 30 which is flange-mounted on the side wall 2. The housing 30 also accommodates a plate 31, against which a compression spring 32 bears. The spring 32 is supported by a thrust bearing 33 on the journal 27 of the cylinder 1.1.

The compression spring 32 in practice replaces a second magnetic coil. Its spring force is directed counter to the pulling force of the magnetic coil 14. In order to hold the cylinder 1.1 in s specific position, the spring force maintains equilibrium with the force applied to the disc 13 by the magnetic coil 14. For the purpose of displacing the cylinder 1.1 to the left, the pulling force of the magnetic coil 14 is reduced by driving it appropriately, so that the spring force predominates and the compression spring 32 displaces the cylinder 1.1 accordingly until the spring force and the force of the magnetic coil 13 maintain equilibrium. Conversely, in order to displace the cylinder 1.1 to the right, the energization of the magnetic coil 14 is increased, so that the disc 13 is pulled in the direction of the magnetic coil 14 and the cylinder 1.1 is displaced in this direction counter to the force of the compression spring 32. In order to drive the magnetic coil 14, a circuit is used which is similar to that shown in FIG. 4. For the purpose of avoiding repetitive descriptions, more detailed explanations are omitted.

The grooved ball bearing 12 also has the functions (unchanged with respect to FIG. 1) of the stop of the stop system 11, as collision protector and of a supporting bearing for the highly accurate axial running of the cylinder 1.1. Continuing repetitive descriptions are therefore omitted. Reference should merely be made to the fact that in each case a distance a1, which is greater than the distance a2, has to be implemented between the plate 31 and the disc 13 and between the disc 13 and the magnetic coil 14 (see FIG. 2).

Figure 3:
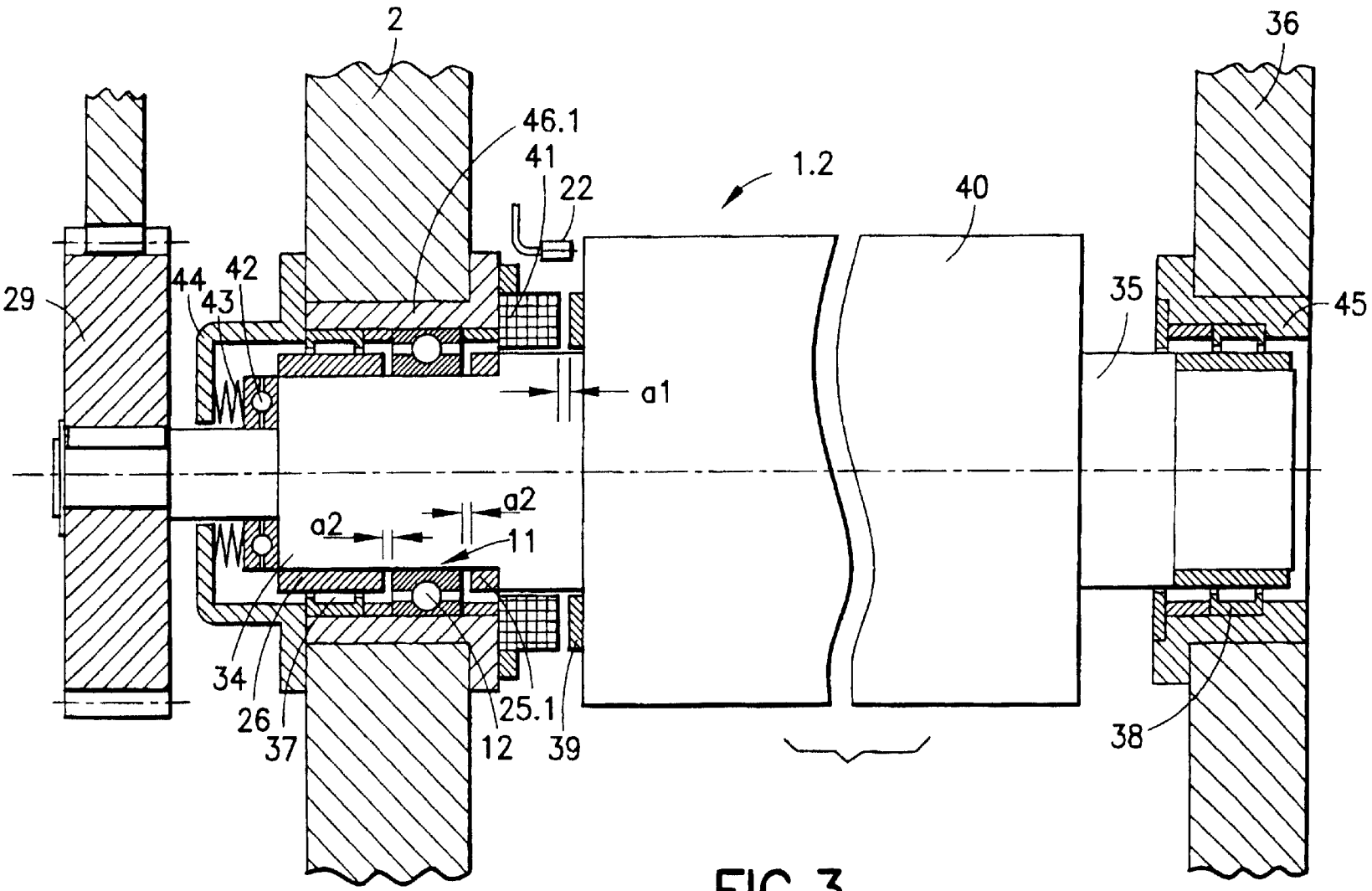
FIG. 3 is a cross-sectional view of a modified embodiment from that shown in FIG. 2.

FIG. 3 shows an embodiment in which, in a manner similar to FIG. 2, one magnetic coil is replaced by a spring. By way of example, a cylinder 1.2 is mounted with its journals 34, 35 on both sides in respective side walls 2, 36. Used for this are radial bearings 37, 38, which permit the cylinder 1.2 to be displaced axially. The drive to the cylinder 1.2 is carried out by means of a spur gear 29 on the journal 34.

A disc 39 of a ferromagnetic material is fastened to one end of the body 40 of the cylinder 1.2. A magnetic coil 41 is positioned at a distance from the free side of the disc 39, and is screwed to the wall 2. In addition, a compression spring 43 bears on the journal 34 of the cylinder 1.2 with the interposition of a thrust bearing 42 and, by its other end, is supported on a cover 44 screwed to the side wall 2.

In the same way as in the function with the exemplary embodiment according to FIG. 2, the force applied by the magnetic coil 41 and the spring force of the compression spring 43 maintain equilibrium, the cylinder 1.2 being held in a specific axial position. Depending on whether the cylinder 1.2 is to be adjusted axially to the left or right, the pulling force of the magnetic coil 41 is increased or reduced by means of appropriately varying its energization. The magnetic coil 41 is driven by a circuit, in a manner similar to that shown in FIG. 4, for which reason an additional description will be omitted in order to avoid repetition. One advantageous fitting of the measured value transmitter 22 used for the position of the cylinder 1.2 to the end of the latter is indicated in FIG. 3. The apparatus according to FIG. 3 also contains the stop system 11 having the grooved ball bearing 12 and the sleeves 25.1 and 26. Here, too, the function is the same as in the preceding exemplary embodiments, for which reason reference is made to the description relating to the exemplary embodiment according to FIG. 1. The distance a1 between the magnetic coil 41 and the disc 39, which must be greater than the distance a2 between the grooved ball bearing 12 and the sleeve 26, is indicated.

Figure 5:
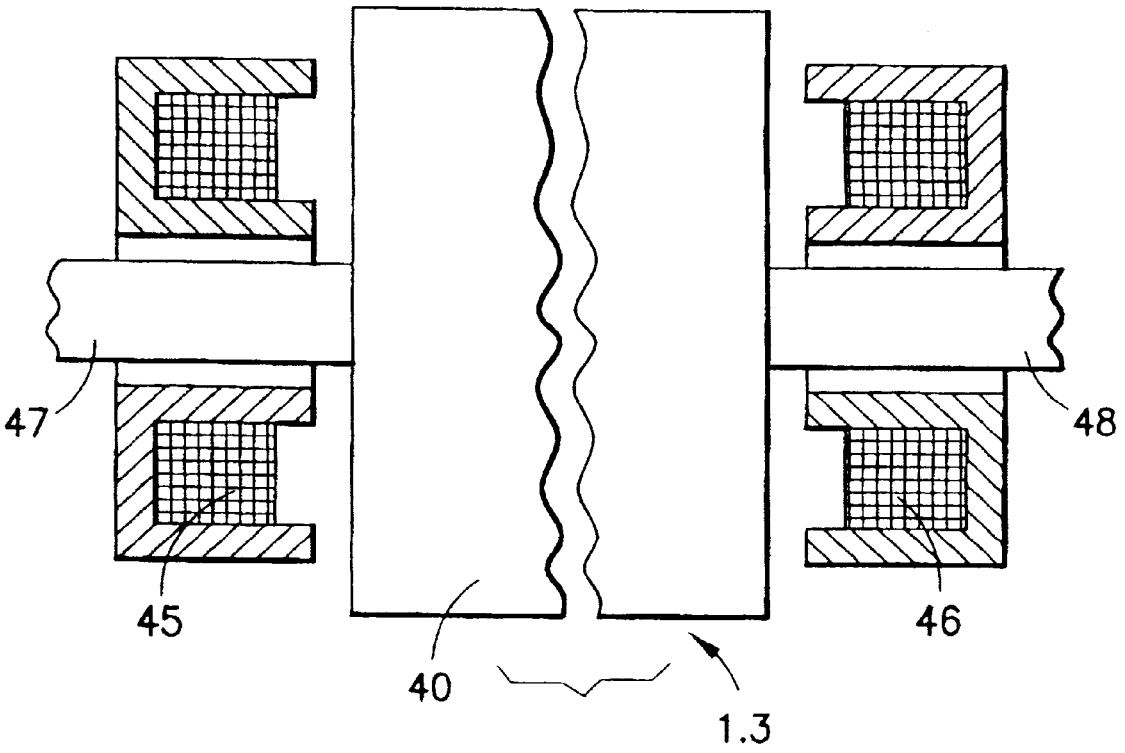
FIG. 5 is a sectional view of a cylinder with magnetic coils arranged at both ends.

According to FIG. 5, by contrast with FIG. 3, no discs 39 are fitted to the ends of a body 40 of a cylinder 1.3. Instead, the ferromagnetic ends of the body 40 of the cylinder 1.3 each interact with a magnetic coil 45, 46 fitted alongside them in each case. Otherwise, the mounting of the journals 47, 48 of the cylinder 1.3 in the side walls is similar to that shown in FIG. 3. By means of the magnetic coils 45, 46, mutually opposed pulling forces can be exerted on the cylinder 1.3. The cylinder 1.3 can be positioned depending on the driving of the magnetic coils 45, 46. By virtue of the ability to apply opposed forces, the provision of a spring 43 is superfluous. The further construction of the apparatus corresponds to that already described. Rings (similar to the ring 39 in FIG. 3) can also be fitted to both ends of the body 40, with which rings the magnetic coils 45, 46 interact.

Figure 6:
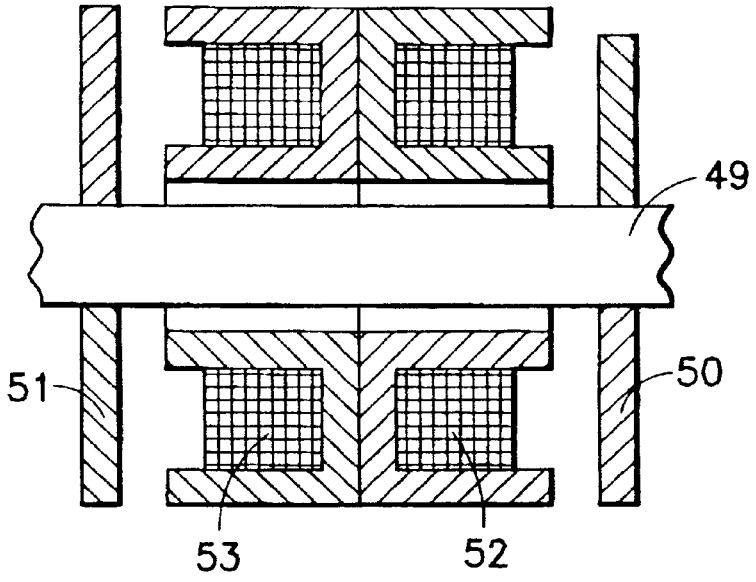
FIG. 6 is a sectional view of a journal of a cylinder which, in contrast to the embodiment of FIG. 1, bears two discs.

According to FIG. 6, two discs 50, 51 of a ferromagnetic material are fastened centrally to a journal 49 (or a spindle) of a cylinder not illustrated. In each case a magnetic coil 52, 53 is positioned on the mutually facing sides of the discs 50, 51. Instead of this, the magnetic coils 52, 53 could also be arranged on those sides of the discs 50, 51 which face away from each other. Also, if there were two journals 49 present, a disc 50, 51 together with associated magnetic coil 52, 53 could be fastened on each. Using the magnetic coils 52, 53, mutually oppositely oriented axial forces can be applied to the discs 50, 51 and therefore to the cylinder (not illustrated) in order to position it. The further construction and the functioning correspond to the exemplary embodiments already described.

In the exemplary embodiments, use is made of surfaces of discs 13, 39, 50, 51 which interact with both sides or only one side with two magnetic coils 14, 15, 52, 53 or only one magnetic coil 14, 41. These sides are advantageously flat and level. However, it is also possible for the sides to be curved to a specific extent, for example whilst maintaining rotational symmetry. It is also possible that, instead of fastening the disc 13, 50, 51 to the journal 3, 27, 49 of the cylinder 1, 1. 1, these are designed as a constituent part of the respective journal 3, 27, 49, for example as an extension. It is also possible to mount the ferromagnetic bodies containing the surface or surfaces such that they are axially undisplaceable, for example on the journal 3, 27, 49. Surfaces of this type, which then do not rotate, do not need to be of continuous design but may have a hole for example. It is also possible, for example, for a journal of the cylinder to be mounted such that it cannot be axially displaced in a bush, which is shifted by means of the magnetic system. FIG. 1 shows a cylinder 1 of a rotary printing machine, which is cantilever-mounted in a side wall 2 (frame). The cylinder 1 is a plate cylinder, however, it could also be another cylinder, for example a transfer cylinder. The cylinder is set up in a spindle design, that is to say the body 4 of the cylinder 1 is flange-mounted on the head of a spindle 3. Other designs and mountings of cylinders are also possible, as will be shown in following exemplary embodiments. The spindle 3, together with the rotor 5 arranged on it and with the stator 6 of a built-in motor 7, is accommodated in a housing 8, which in turn is accommodated in the wall 2. The spindle 3 is mounted in the housing 8 with radial bearings 9, 10 with the ability to be displaced axially, for example cylinder roller bearings. Furthermore, a stop system 11 which does not impair the ability of the cylinder 1 to rotate is arranged in the housing 8 and contains a grooved ball bearing 12 which is accommodated in the bore in the housing 8 and which interacts with two sleeves 25, 26 on the spindle 3.

Also arranged on the cylinder 1 is an electromagnetic system. In detail, a disc 13 made of a ferromagnetic material is fastened on the spindle 3, in each case a magnetic coil 14, 15 accommodated in the bore of the housing 8 being arranged on both sides of the disc, at a distance from the sides. The disc 13 incorporates two mutually oppositely oriented ferromagnetic surfaces. In order to achieve a high operating accuracy of the apparatus, the surfaces of the disc 13 have the lowest possible axial run-out, and the disc 13 is extremely homogeneous, for example does not contain any voids.

The magnetic coils 14, 15 of the electromagnetic system are driven by a register control system, as shown in FIG. 4. In detail, a sensor 17, which scans register marks printed on a web 18, is connected to the input of a comparison device 19, to which a signal for the desired value of the register is also fed. On the output side, the comparison device 19 is connected via a control device 20 to a further comparison element 21. A measured value transmitter 22 for the position of the cylinder 1 is connected to the second input of the comparison element 21. On the output side, the comparison device 21 is connected via a control device 23 and an amplifier 24 to the magnetic coils 14, 15 of the electromagnetic system.

The signal supplied by the sensor 17 for the actual value of the register is compared with a desired value in the comparison element 19. The difference signal obtained in this way, conditioned by the control device 20, is fed to the comparison element 21 and there is compared with the signal supplied by the measured value transmitter 22 for the actual position of the cylinder 1. In the event of a deviation from the desired value, a difference signal is forwarded to the control device 23. There, the signal for driving the magnetic coils 14, 15 is prepared and fed to the coils after appropriate amplification in the amplifier 24. In the driven state, that is to say when they are energized, the magnetic coils 14, 15 exert pulling forces on the disc 13. The disc 13 is shifted in the direction of the magnetic coil which exerts the greater attractive force on it.

The adjustment operation preferably takes place when the spindle 3 is rotating. As a result, the adjustment does not take place with any sliding displacement in the direction of the circumferential contact lines of the rolling elements, but in a less harmful manner by rolling helically on the rolling elements. When it is established that the desired position of the cylinder 1 has been reached based on the signal output by the measured value transmitter the magnetic coils 14, 15 are energized such that the position is maintained.

The apparatus uses the position of the cylinder 1, determined by measurement, for the active control of the energization of the two magnets. As a result, stable, freely selectable, accurate axial positioning of the cylinder 1 can be achieved. The measured value transmitter 22 used is advantageously a non-contacting, inductive, capacitive, optical, interferometric or mechanical sensor. The reference surface needed for the measured value transmitter 22, which surface can be designed as a disc, for example, is advantageously fitted close to the body 4 of the cylinder, for example on the head of the spindle 3 which bears the body 4 or at the end of the body 4 of the cylinder. As a result, disruptive influences, such as problems with electromagnetic compatibility thermal influences, for example thermal expansion of the spindle 3, and contamination are minimized.

The distances a2 between the sleeves 25, 26, and the grooved ball bearing 12 (FIG. 1), as well as the distances a1 between the magnetic coils 14, 15 and the disc 13, are such that, assuming central positions of the grooved ball bearing 12 and of the disc 13, a2 is less than a1. In the end positions, the sleeves 25, 26 strike the grooved ball bearing 12 and thus limit the axial displacement travel of the cylinder 1. In addition, this stop system 11 means that damage is avoided in the event of any disruption to the electromagnetic system 14, 15. In the case of any possible disruption of this type, the cylinder 1 can run down to a standstill without any risk and without any further axial guidance. Sleeves 25, 26 may strike the grooved ball bearing 12, by which means any mechanical collision between the disc 13 and the magnetic coils 14, 15, and any associated damage, is avoided.

The stop system 11 having the grooved ball bearing 12 and the sleeves 25, 26 can also be employed for very accurate axial positioning of the cylinder 1, such as is required for example for the direct imaging of a plate cylinder in the printing machine. For this purpose, the magnetic coils 14, 15 are driven such that the sleeves 25, 26 of the cylinder 1 are in contact with the grooved ball bearing 12. The ground bearing 12 performs the function of a supporting bearing and guarantees the highest accuracy with regard to the axial running of the cylinder 1 as it rotates. This axial stop can also be implemented in another way, for example by means of angled ball bearings or tapered roller bearings arranged in pairs.

FIG. 2 shows a further embodiment, in which one magnetic coil is replaced by a spring. For the purpose of simplification, in this exemplary embodiment and in the one following, in the case of repeated and similar components the same item numbers are used, if necessary with the addition of "0.1", "0.2". A cylinder 1.1, by way of example not designed with a spindle and flange-mounted body, is cantilever-mounted with its journal 27 in the side wall 2. The mounting is carried out in a bush 28 accommodated in the side wall 2, otherwise in the latter by means of radial bearings 9, 10, analogously to FIG. 1. Also provided is the grooved ball bearing 12, which interacts with the sleeves 25, 26. In order to drive the cylinder 1.1, a spur gear 29 is arranged on its journal 27. The drive could also be carried out by means of a dedicated motor, for example in a manner similar to the design according to FIG. 1. Fastened on the journal 27 of the cylinder 1.1 is a disc 13 of a ferromagnetic material, on one of whose sides, which supplies a ferromagnetic surface, and at a distance from the said side there is arranged a magnetic coil 14. The magnetic coil 14 is fastened in a housing 30 which is flange-mounted on the side wall 2. The housing 30 also accommodates a plate 31, against which a compression spring 32 bears. The spring 32 is supported by a thrust bearing 33 on the journal 27 of the cylinder 1.1.

The compression spring 32 in practice replaces a second magnetic coil. Its spring force is directed counter to the pulling force of the magnetic coil 14. In order to hold the cylinder 1.1 in s specific position, the spring force maintains equilibrium with the force applied to the disc 13 by the magnetic coil 14. For the purpose of displacing the cylinder 1.1 to the left, the pulling force of the magnetic coil 14 is reduced by driving it appropriately, so that the spring force predominates and the compression spring 32 displaces the cylinder 1.1 accordingly until the spring force and the force of the magnetic coil 13 maintain equilibrium. Conversely, in order to displace the cylinder 1.1 to the right, the energization of the magnetic coil 14 is increased, so that the disc 13 is pulled in the direction of the magnetic coil 14 and the cylinder 1.1 is displaced in this direction counter to the force of the compression spring 32. In order to drive the magnetic coil 14, a circuit is used which is similar to that shown in FIG. 4. For the purpose of avoiding repetitive descriptions, more detailed explanations are omitted.

The grooved ball bearing 12 also has the functions (unchanged with respect to FIG. 1) of the stop of the stop system 11, as collision protector and of a supporting bearing for the highly accurate axial running of the cylinder 1.1. Continuing repetitive descriptions are therefore omitted. Reference should merely be made to the fact that in each case a distance a1, which is greater than the distance a2, has to be implemented between the plate 31 and the disc 13 and between the disc 13 and the magnetic coil 14 (see FIG. 2).

FIG. 3 shows an embodiment in which, in a manner similar to FIG. 2, one magnetic coil is replaced by a spring. By way of example, a cylinder 1.2 is mounted with its journals 34, 35 on both sides in respective side walls 2, 36. Used for this are radial bearings 37, 38, which permit the cylinder 1.2 to be displaced axially. The drive to the cylinder 1.2 is carried out by means of a spur gear 29 on the journal 34.

A disc 39 of a ferromagnetic material is fastened to one end of the body 40 of the cylinder 1.2. A magnetic coil 41 is positioned at a distance from the free side of the disc 39, and is screwed to the wall 2. In addition, a compression spring 43 bears on the journal 34 of the cylinder 1.2 with the interposition of a thrust bearing 42 and, by its other end, is supported on a cover 44 screwed to the side wall 2.

In the same way as in the function with the exemplary embodiment according to FIG. 2, the force applied by the magnetic coil 41 and the spring force of the compression spring 43 maintain equilibrium, the cylinder 1.2 being held in a specific axial position. Depending on whether the cylinder 1.2 is to be adjusted axially to the left or right, the pulling force of the magnetic coil 41 is increased or reduced by means of appropriately varying its energization. The magnetic coil 41 is driven by a circuit, in a manner similar to that shown in FIG. 4, for which reason an additional description will be omitted in order to avoid repetition. One advantageous fitting of the measured value transmitter 22 used for the position of the cylinder 1.2 to the end of the latter is indicated in FIG. 3. The apparatus according to FIG. 3 also contains the stop system 11 having the grooved ball bearing 12 and the sleeves 25.1 and 26. Here, too, the function is the same as in the preceding exemplary embodiments, for which reason reference is made to the description relating to the exemplary embodiment according to FIG. 1. The distance a1 between the magnetic coil 41 and the disc 39, which must be greater than the distance a2 between the grooved ball bearing 12 and the sleeve 26, is indicated.

According to FIG. 5, by contrast with FIG. 3, no discs 39 are fitted to the ends of a body 40 of a cylinder 1.3. Instead, the ferromagnetic ends of the body 40 of the cylinder 1.3 each interact with a magnetic coil 45, 46 fitted alongside them in each case. Otherwise, the mounting of the journals 47, 48 of the cylinder 1.3 in the side walls is similar to that shown in FIG. 3. By means of the magnetic coils 45, 46, mutually opposed pulling forces can be exerted on the cylinder 1.3. The cylinder 1.3 can be positioned depending on the driving of the magnetic coils 45, 46. By virtue of the ability to apply opposed forces, the provision of a spring 43 is superfluous. The further construction of the apparatus corresponds to that already described. Rings (similar to the ring 39 in FIG. 3) can also be fitted to both ends of the body 40, with which rings the magnetic coils 45, 46 interact.

According to FIG. 6, two discs 50, 51 of a ferromagnetic material are fastened centrally to a journal 49 (or a spindle) of a cylinder not illustrated. In each case a magnetic coil 52, 53 is positioned on the mutually facing sides of the discs 50, 51. Instead of this, the magnetic coils 52, 53 could also be arranged on those sides of the discs 50, 51 which face away from each other. Also, if there were two journals 49 present, a disc 50, 51 together with associated magnetic coil 52, 53 could be fastened on each. Using the magnetic coils 52, 53, mutually oppositely oriented axial forces can be applied to the discs 50, 51 and therefore to the cylinder (not illustrated) in order to position it. The further construction and the functioning correspond to the exemplary embodiments already described.

In the exemplary embodiments, use is made of surfaces of discs 13, 39, 50, 51 which interact with both sides or only one side with two magnetic coils 14, 15, 52, 53 or only one magnetic coil 14, 41. These sides are advantageously flat and level. However, it is also possible for the sides to be curved to a specific extent, for example whilst maintaining rotational symmetry. It is also possible that, instead of fastening the disc 13, 50, 51 to the journal 3, 27, 49 of the cylinder 1, 1.1, these are designed as a constituent part of the respective journal 3, 27, 49, for example as an extension. It is also possible to mount the ferromagnetic bodies containing the surface or surfaces such that they are axially undisplaceable, for example on the journal 3, 27, 49. Surfaces of this type, which then do not rotate, do not need to be of continuous design but may have a hole for example. It is also possible, for example, for a journal of the cylinder to be mounted such that it cannot be axially displaced in a bush, which is shifted by means of the magnetic system.

The invention is not limited by the embodiments described above which are presented as examples only but can be modified in various ways within the scope of protection defined by the appended patent claims.

We claim:

1. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising: two mutually oppositely oriented ferromagnetic surfaces arranged on the cylinder; and a magnetic coil, each of said two ferromagnetic surfaces interacting with said magnetic coil.

2. The apparatus according to claim 1, wherein the cylinder comprises one of a plate cylinder and a transfer cylinder in the rotary printing machine.

3. The apparatus according to claim 1, further comprising a stop arranged such that the cylinder may be axially moved by said electromagnetic system against and onto said stop, said stop maintaining the rotating ability of the cylinder.

4. The apparatus according to claim 1, further comprising a stop system arranged on the cylinder and is adapted to maintain the rotating ability of the cylinder and limits axial displacement travel of the cylinder.

5. The apparatus according to claim 1, further comprising a register control system having an output connected to said electromagnetic system, said register control driving said electromagnetic system.

6. The apparatus according to claim 5, further comprising:

a measured value transmitter for determining a position of the cylinder and generating a signal representative of the cylinder position; and a comparison element having a first input receiving the signal representative of the cylinder position, a second input connected to the register control system and an output connected to said electromagnetic system, said register control system providing predefined values to said comparison element via said second input.

7. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising: a disk of a ferromagnetic material centrally fastened to the cylinders; and a magnetic coil disposed on each side of said disk.

8. The apparatus according to claim 7, wherein the cylinder further comprises a journal, wherein said disc is arranged on said journal.

9. The apparatus according to claim 7, further comprising a stop arranged such that the cylinder may be axially moved by said electromagnetic system against and onto said stop, said stop maintaining the rotating ability of the cylinder.

10. The apparatus according to claim 7, further comprising a stop system arranged on the cylinder and adapted to maintain the rotating ability of the cylinder and limit axial displacement travel of the cylinder.

11. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising: two disks of a ferromagnetic material centrally fastened to the cylinder, said two disks having mutually facing and non-facing sides; and a magnetic coil positioned on one of the facing and non-facing sides of each of said two disks.

12. The apparatus according to claim 11, wherein the cylinder further comprises a journal, wherein said discs are arranged on said journal.

13. The apparatus according to claim 11, further comprising a stop arranged such that the cylinder may be axially moved by said electromagnetic system against and onto said stop, said stop maintaining the rotating ability of the cylinder.

14. The apparatus according to claim 11, further comprising a stop system arranged on the cylinder and adapted to maintain the rotating ability of the cylinder and limit axial displacement travel of the cylinder.

15. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising a magnetic coil arranged at respective ends of the cylinder, each magnetic coil interacting with the ends of the cylinder.

16. The apparatus according to claim 15, further comprising a stop arranged such that the cylinder may be axially moved by said electromagnetic system against and onto said stop, said stop maintaining the rotating ability of the cylinder.

17. The apparatus according to claim 15, further comprising a stop system arranged on the cylinder and adapted to maintain the rotating ability of the cylinder and limit axial displacement travel of the cylinder.

18. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising: a ferromagnetic surface arranged on the cylinder; a magnetic coil positioned adjacent said ferromagnetic surface; and a spring supported on the cylinder and having a spring force opposing a pulling force of said magnetic coil.

19. The apparatus according to claim 18, further comprising a stop arranged such that the cylinder may be axially moved by said electromagnetic system against and onto said stop, said stop maintaining the rotating ability of the cylinder.

20. The apparatus according to claim 18, further comprising a stop system arranged on the cylinder and adapted to maintain the rotating ability of the cylinder and limit axial displacement travel of the cylinder.

21. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction; and mounting means for mounting the plate cylinder in the printing machine and enabling axial displacement of the cylinder, said electromagnetic system comprising a disk of a ferromagnetic material centrally fastened to the cylinder; and a magnetic coil arranged on one side of said disk.

22. The apparatus according to claim 21, wherein said disc is disposed on one end of the cylinder.

23. The apparatus according to claim 21, wherein the cylinder further comprises a journal, wherein said disc is arranged on said journal.

24. The apparatus according to claim 21, further comprising a stop arranged such that the cylinder may be axially moved by said electromagnetic system against and onto said stop, said stop maintaining the rotating ability of the cylinder.

25. The apparatus according to claim 21, further comprising a stop system arranged on the cylinder and adapted to maintain the rotating ability of the cylinder and limit axial displacement travel of the cylinder.

26. An apparatus for axially guiding and adjusting a cylinder for register position in a rotary printing machine comprising:

an electromagnetic system arranged on a frame of the rotary printing machine and adapted to selectively apply an axial magnetic force to the cylinder in an axial direction;

mounting means for mounting the plate cylinder in the printing machine and enabling axial displacement of the cylinder;

a register control system having an output connected to said electromagnetic system, said register control driving said electromagnetic system;

a measured value transmitter for determining a position of the cylinder and generating a signal representative of the cylinder positions; and a comparison element having a first input receiving the signal representative of the cylinder position, a second input connected to the register control system and an output connected to said electromagnetic system, said register control system providing predefined values to said comparison element via said second input.

* * * * *